United States Patent [19]

Breithaupt, Albert

[11] Patent Number: 4,463,530

[45] Date of Patent: Aug. 7, 1984

[54] FLAME-VIEWING WINDOW ASSEMBLY

[75] Inventor: Breithaupt, Albert, Cologne, Fed. Rep. of Germany

[73] Assignee: Trube & Kings KG, Cologne, Fed. Rep. of Germany

[21] Appl. No.: 317,320

[22] Filed: Nov. 2, 1981

[30] Foreign Application Priority Data

Nov. 3, 1980 [DE] Fed. Rep. of Germany ..... 3041385

[51] Int. Cl.[3] ..... E06B 7/12

[52] U.S. Cl. ..... 52/171; 52/400

[58] Field of Search ..... 52/171, 400, 767, 208

[56] References Cited

U.S. PATENT DOCUMENTS 2,258,724 10/1941 Wagner et al. ..... 52/208 X
2,733,789 2/1956 Tolle ..... 52/400
4,327,967 5/1982 Groth ..... 52/171 X

FOREIGN PATENT DOCUMENTS 1784215 7/1971 Fed. Rep. of Germany ..... 52/400
2413552 9/1975 Fed. Rep. of Germany .
2328737 10/1975 Fed. Rep. of Germany .
2344459 2/1976 Fed. Rep. of Germany .

*Primary Examiner*—Carl D. Friedman
*Attorney, Agent, or Firm*—Karl F. Ross; Herbert Dubno

[57] ABSTRACT

A flame window adapted to serve window separating a flame side from another side of a structure or vehicle or as a viewing window for a firebox or the like comprises a frame in which a lime-soda-silicate (soda-lime) glass is anchored by clamping all around its periphery in a heat-insulating bed. The soda-lime glass has a product of thermal coefficient of linear expansion and modulus of elasticity which is greater than 0.5 $N \cdot mm^{-2} \cdot k^{-1}$.

10 Claims, 2 Drawing Figures

FLAME-VIEWING WINDOW ASSEMBLY

FIELD OF THE INVENTION

My present invention relates to a flame-viewing window assembly and, more particularly, to a window assembly separating a fire compartment from space around this compartment and through which flame within the compartment can be viewed.

BACKGROUND OF THE INVENTION

Flame-viewing windows are provided for many applications, of which perhaps the most significant is the use of the window to separate a flame side of a structure from another side or to permit viewing of a combustion chamber and, especially, the flame within this combustion chamber. Such windows can be provided on boilers, reactors, heaters or other apparatus in which a flame is produced and where viewing of this flame may be desired, simply to determine whether the flame is on or is satisfactory, for control of combustion parameters, for monitoring flame temperature, or for any other reason which may require frequent or infrequent viewing of the flame.

Flame safety glasses may be used as panes for such windows and a particularly effective glass-ceramic pane is described in German Open Application—DE-OS No. 24 13 552, for example. This high grade expensive pane is held in place all around its periphery by heat-insulating means and has been found to be highly stable although the high cost of the assembly has prevented widespread acceptance and application of such windows.

Lower cost lime-soda-silicate glasses (soda-lime glass) have been avoided because they have been associated with the development of high stresses when subjected to use in the manner described and hence special methods of anchoring panes of this type of glass have been developed as shown, for example, in German Printed Application DE-AS No. 23 44 459 to position the panes in the manner enabling the distortion thereof without breakage.

In general such means only retains the pane at limited locations about the periphery thereof. Thus, while the panes of this latter approach are less expensive, the higher cost and complexity of the frame has created problems. Up to now both methods have proved to be unsatisfactory and unacceptable in many cases.

OBJECTS OF THE INVENTION

It is the principal object of the present invention to provide an improved window assembly for the purposes described which is inexpensive, has long useful life and is free from the disadvantages of earlier systems.

Another object of this invention is to provide a fire-viewing window which is of high stability and low cost and contributes structural simplicity to the art of fire-viewing windows.

SUMMARY OF THE INVENTION

These objects and others which will become apparent hereinafter are based upon my surprising discovery that soda-lime glasses having a product of linear thermal coefficient of expension and modulus of elasticity which is greater than $0.5N \cdot mm^{-2} \cdot k^{-1}$ can be anchored in a peripherally closed heated insulating member, preferably one in which the edge of the pane is embedded, and the edge portion of the pane clamped all around the periphery of the latter in a support frame to provide a frame-viewing window assembly which is not only of low cost but also has unexpectedly high stability under the conditions of use so that expensive partial mounting arrangements can be avoided.

It is particularly surprising that such lime-soda-silicate glass, i.e. low cost soda-lime glass, can be clamped with clamping forces uniformly all around the edge of a pane of this glass as, for example, in German patent document No. 23 28 737 to yield a flame-viewing window with excellent resistance to the effect of the flame and particularly to long life.

Heretofore it had been expected that soda-lime glasses could not be used in this manner because, as this publication indicates, rapid breakage was the rule.

According to a feature of this invention, the soda-lime glass pane is retained in the frame by a U-section bedding mass, bead, strip of a yieldable composition which can be elastic or non-elastic and which is composed of a material of a low thermal conductivity, for example, a glass fiber cement, a cellulose fiber-reinforced plaster, ceramic fiber in long staple, rope or roving form such as the product marketed under the name FIBERFRAX by Harbison Carborundum Corp., or an elastomer such as a silicone rubber having refractory properties. Plasterboard channels may be used for this purpose as well.

According to the invention, moreover, the anchored edges of the pane should penetrate into the frame to a depth less than 16 mm and the edge portion of the glass pane should be retained under a pressure sufficient to hold it in place but at most equal to $50N/cm^2$.

The pane is, moreover, advantageously a float glass which is provided along its face turned away from the flame formed with heat-reflective coating. The coating should have the capacity to maintain its reflective character for up to 15 minutes. This is of advantage where the glass pane is provided between two spaces, one of which may be subject to fire, the reflective layer evaporating or otherwise being destroyed upon the development of a fire to expose the fire through the window.

In such cases, the glass can be used in single-pane or multipane window frames in corresponding locations in a structure.

It has been found to be advantageous, moreover, to provide the frame so that it has a low mass and thus low thermal capacity but good heat conductivity, e.g. of aluminum. The frame most desirably has a dark color which can be applied by painting, coating, dipping or even anodization.

Experiments have shown that best results are obtained when the glass thickness is at least 3 mm and the glass panes are ground and preferably polished along their edges, advantageously being bevelled as well. The edge portions of the pane may also be thicker than the central portions surrounded by the thickened bead and the edge region can be protected by a metal or synthetic resin foil, a strip of U-cross section (i.e. a profile) or with protective layers or films of enamel or organic coating materials to protect these edge portions mechanically.

The glass panes of the invention can withstand one or twosided exposure to flames in accordance with the German Industrial Standard DIN 4102 such that their integrity-temperature-time curve (ETK) does not show a jump or break within the first fifteen minutes. In fact, much longer periods of exposure to flame is required before the jump is observed. The glass pane also does not appear to distort in the flame.

The window assemblies of the invention thus can be used effectively for internal and external glazing of building and for vehicles, aircraft and ships wherever separation of a fire zone from another zone is required.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
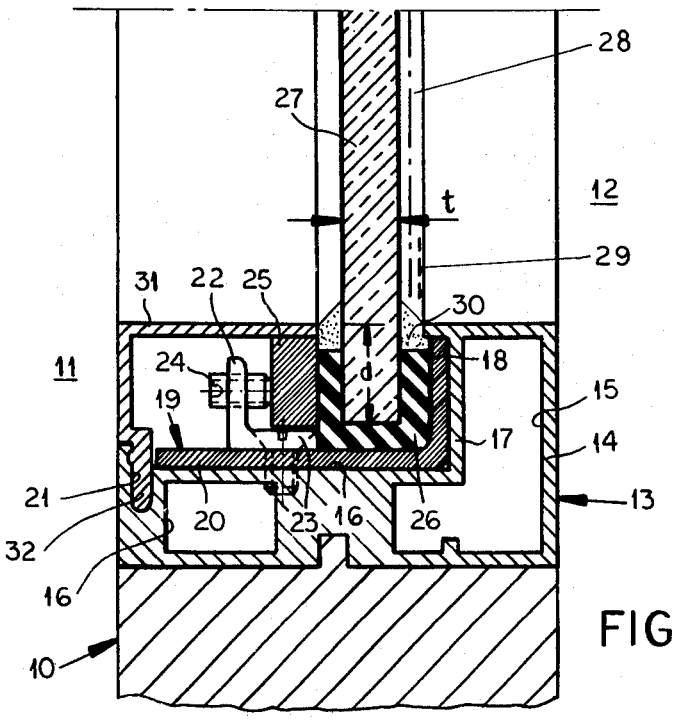
FIG. 1 is a cross-sectional view through a window assembly according to the invention.

The window assembly shown in the drawing is intended to be installed in a wall 10 separating a compartment 11 in which a fire may develop from a compartment 12 which is at least in part to be isolated from the fire by the wall 10. Typical examples of the use of such windows have been given above.

According to the invention, the assembly comprises a frame 13 which is anchored in the wall 10 and can be formed from an aluminum profile strip 14 having channels 15 and 16 to minimize its mass, the aluminum metal ensuring excellent thermal conductivity.

To increase the strength of the frame, the latter is formed with a ledge 16 having an upstanding web 17 against which the foot 18 of an L-shaped bracket 19 rests. This bracket has a shank 20 lying along the ledge 16 which is formed with an upwardly open recess 21.

Angle members 22 are held at spaced-apart locations by screws 23 to the ledge 16, these screws passing through the shank 20 and securing the bracket 19 in place.

An upstanding portion of each angle 22 threadedly receives a screw 24 which clamps a bar 25 against the bedding mass 26 of thermally insulating material and in which the pane 27 of the soda lime glass is received.

The depth of penetration d of the pane into the channel is less than 16 mm and the thickness t of the pane is greater than 3 mm. The pane is formed with a reflection layer 28 and can be further covered by a partially reflective layer 29 as well. The low thermal conductivity bedding mass is sealed in place by beads 30 and 31 or refractory silicone rubber or putty.

The pressure strip 25 and the screws 24 which apply the pressure are concealed by a cover profile 31 which has a foot 32 snap-fitted into the recess 21.

Figure 2:
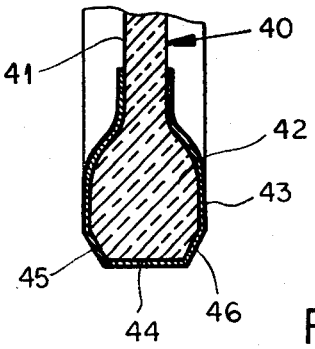
FIG. 2 is a section through an edge portion of a pane of another window.

In FIG. 2 I have shown that the pane 40 can have a thin central portion 41 and a large bead 42 along the periphery engaged in the frame, this bead being protected by an enamel layer 43 and having a polished edge 44 with bevelled portions 45, 46.

I claim:

1. A fire window assembly adapted to separate a fire space from another space, said assembly comprising:

a frame having an inwardly open channel all around the frame;

a pane of soda lime glass having a thickness of at least 3 mm received in said frame with a continuous peripheral edge portion extending into said channel to a depth less than 16 mm;

a bedding mass of low thermal conductivity enclosing said edge portion in said channel and thermally insulating said pane from said frame, said pane being composed of a lime-soda-silicate glass with a product of thermal coefficient of linear expansion and modulus of elasticity which is greater than $0.5N \cdot mm^{-2} \cdot K^{-1}$.

2. The assembly defined in claim 1, further comprising means for applying a pressure to said edge portion of said pane in said frame up to $50N/cm^2$.

3. The assembly defined in claim 1 wherein said pane is a float glass formed with a reflective layer having a life of up to 15 minutes.

4. The assembly defined in claim 1 wherein said frame has low mass and heat capacity but high thermal conductivity.

5. The assembly defined in claim 1 wherein said frame has dark-colored surfaces.

6. The assembly defined in claim 1 wherein said pane has ground edges.

7. The assembly defined in claim 6 wherein said edges are polished.

8. The assembly defined in claim 1 wherein said pane has bevelled edges.

9. The assembly defined in claim 1 wherein the thickness of the glass of said pane is greater along said edge portions than inwardly thereof.

10. The assembly defined in claim 1 wherein said edge portions are enveloped in a protective layer.

* * * * *